United States Patent [19]

Schultz et al.

[11] 4,422,527

[45] Dec. 27, 1983

[54] TREE STEPS

[75] Inventors: William E. Schultz, Okemos; Jeffrey S. Vogl, Lansing, both of Mich.

[73] Assignee: Vogl-Schultz, Incorporated, Okemos, Mich.

[21] Appl. No.: 428,195

[22] Filed: Sep. 29, 1982

[51] Int. Cl.[3] ..... A63B 29/04

[52] U.S. Cl. ..... 182/92; 182/187

[58] Field of Search ..... 182/92, 133–136, 182/221, 90, 91, 187, 189; 248/219.4, 231, 217.1, 1

[56] References Cited

U.S. PATENT DOCUMENTS

| | | | |
|---|---|---|---|
| 471,626 | 3/1892 | Streeter | 182/90 |
| 480,941 | 8/1892 | Stow | 182/187 |
| 907,483 | 12/1908 | Ette | 182/90 |
| 2,209,875 | 7/1940 | Eichelsdoerper | 248/231 |
| 2,392,538 | 1/1946 | Knudsen | 182/134 |
| 2,908,470 | 10/1959 | Garman | 248/231 |
| 3,957,237 | 5/1976 | Campbell | 248/1 |
| 4,109,761 | 8/1978 | Matlock | 182/92 |
| 4,230,203 | 10/1980 | Sweat | 182/134 |

FOREIGN PATENT DOCUMENTS

| | | | |
|---|---|---|---|
| 2345651 | 11/1977 | France | 248/219.4 |

*Primary Examiner*—R. P. Machado
*Assistant Examiner*—Alvin Chin-Shug
*Attorney, Agent, or Firm*—Miller, Morriss & Pappas

[57] ABSTRACT

A lightweight ecologically oriented shell-like device comprising, with a strap, portably useable tree climbing steps in which the application of stresses in climbing seat the steps firmly and without digging into or displacing the bark and wood of trees and similar vertical cylindrical structures. These devices are useful for hunters, for woodsmen, for utility pole climbing, and the like.

8 Claims, 7 Drawing Figures

TREE STEPS

The present invention is a lightweight shell step unit structure with clamping strap holding means. These step units may be plurally used in staggered sequence on the trunk of a tree or the like to provide steps facilitating the climbing of the tree. The devices are compactly and nestably stacked for packing and carrying and are preferably formed from noncorrosive high strength filled resin or plastic as, for example, a polycarbonate such as LEXAN (a product of General Electric Co.) and filled with about 12 percent of fiberglass by weight. Each step unit is substantially identical and each successive unit nests in the previous unit. The units are truncated pyramidal hollow or shell-like and have a generally triangular profile, and are truncated below the apex to accommodate a piece of belting as, for example, web belting which runs flatly through the truncation and closes adjustably in an object-girdling manner. Internally, the shell structure is reinforced with variant stock thicknesses and strengthening ribs in maintenance of light weight and high strength. In attachment to trees, for example, the tree climber units are secured to the tree by means of the tree girdling web belts. This causes the truncated portion to rest closest to the tree and for the ramp or leg portions extending therefrom to stand off from the tree at the angle between the equal faces. When a load is applied to the uppermost of the faces, a lever action results at the truncation and the lowermost equal face pivots into contact with the tree in a straddle manner and slightly sliding downward to cinch lock the webbing. As thus presented, the upper face of the step unit tilts slightly inwardly toward the trunk of the tree and is supported by strap and straddle in a three directional stability while providing foot comfort and stabilization to the climber or user since the force from the foot urges ankle and leg contact toward the tree. The web or belt is provided with quick cinching and disconnect means so that the step units are easily positioned and are locked into their initial position and are easily removed as desired.

Contact edges between step elements and tree are rounded so that no serious digging or penetrating damage can be done to the bark or wood of the tree. At most, the web and the straddle feet crush the bark slightly and in some instances scuff the bark as the slip-locking or cinching slip occurs.

The step units herein described are lightweight, tough and durable, are easy to use and pack or store and are relatively inexpensive. The simplicity is appreciated in the design in which each step unit comprises one part and retains the webbing. Most importantly, the step units are ecologically significant in absolute minimization of damage to bark or wood since the structure utilizes non-penetrating forces to secure the steps in place using forces substantially parallel to the vertical surface and wedge. Each step unit is easily locatable and fastened and are easily removable by the hunter or climber.

OBJECTS

The principal object is to provide a portable tree step unit which is light in weight, has minimal parts, and which is stackable or nestable for transport and storage.

Another object is to provide such a step unit that is stable and easily attached to a tree or other vertical cylindrical object and where the stability arises from a straddle and surface area three surface contact.

Still another object is to achieve maximum portability and stability with a cinch lock against the tree, post or column in which the foot support surface of the step tilts the foot slightly toward the tree trunk or vertical object and applies a substantially vertical locking force.

Other objects including improved safety and utility with economy and ecological benefit will be appreciated as the description proceeds.

PRIOR ART

Contrasted to the prior art, which falls into two basic categories of, (a) devices clamping to the shoes or boots of the user and (b) devices attachable and removable from trees, the present device does not require any specific gouging or penetration of the surface of the column or tree and utilizes a straddle-bearing and wedge-like leverage to achieve firm and stable connection. The present invention does not contemplate attachment of the device to the feet or leg of a user. The closest prior art tree attached devices known to the inventors are found in the U.S. Pat. No. 2,392,538 to C. J. Knudsen in which a substantially hemispheric yoke is dug into a tree and clamped in place. Similarly, the Tree Climbing Apparatus of George Sweat in the U.S. Pat. No. 4,230,203 involves shearing into a tree trunk with attendant penetration of bark and wood while adjustably and rigidly girdling a tree. The U.S. Pat. Nos. 471,626 and 907,483 to E. A. Streeter and C. G. Ette disclose devices driven deeply into the tree and through the bark or outer surface. These devices are regarded as causing ecological damage and the present tree steps are structurally and functionally different in concept than the known prior art. The inventors developed earlier climbing devices which relied heavily upon gouging or digging the step elements into the softer bark and wood. By contrast, the present invention seeks to increase the surface area of contact in avoidance of surface penetration and to utilize a web clamping leverage to cinch and to retain the step units under load.

GENERAL DESCRIPTION

In general, the tree step units of the present invention are lightweight shell-like structures reinforced internally and having a generally truncated pyramidal exterior. The base of a unit is rectangular and longer in one direction then the other and the profile from the longer base is that of a triangle having equal acute angles at the base and which, if extended to an apex, would have an included preferred angle at the apex of about 105 degrees. The base rises vertically before merging with the lines converging toward the apex. From the shorter base, the included angle at the apex is sharper or more acute and less than 90 degrees of included angle. From the vantage point of the shorter base, a tunnel or channel is opened transversely through the structure and this provides a partial bifurcation of the sides above the shorter base and forms a pair of extending legs on both sides of the tunnel which are terminally rounded like toes and for feet on their projecting extremities. These feet are an extension of the base corresponding to the rises on each end of the longer sides and the feet are rounded on their exteriors. The truncation of the pyramidal structure provides an upper barrier or platform ceiling slotted adjacent the faces of the larger sides for the running insertion of a belt or webbing. This describes a pyramidal shell having a generally rectangular base and cut away to form the spaced-apart legs on two of the four sides. Reinforcing webs, and selected thickened internal portions of the walls with fillets and rounds, provide reinforcement as required. The rectangular bottom of the structure is open allowing the step units to be compactly stacked. The shells are formed from reinforced plastic as, for example, LEXAN (a polycarbonate plastic produced by the General Electric Co.) filled with about 12 percent by weight of fiberglass.

The consequent cast or molded steps are light in weight and are very tough and strong. Belting or webbing is passed through the structure and the openings adjacent the upper barrier or platform and the webbing is provided with adjustable tying and clenching means as a quick-disconnect lock plate. By knotting the webbing intermediate the ends thereof so that the knot is below the platform formed by the truncation, the webbing remains in place while the free ends of the webbing extend from the slots or openings at the barrier for selectively and adjustably securing the webbing around a tree or a column or a post or even a flagpole or ship mast. When so secured, the truncation is drawn into registry against the tree and the legs extend vertically and in general planes 105 degrees from each extreme of travel. The user or climber stresses the structure by standing on the upper one of the divergent surfaces forming the step unit. This results in a pivoting of the step unit and a slight slipping of web or strap with the step unit to straddle-wedge the step unit against the tree in a non-bark penetrating manner while providing a slightly slanted support for the foot. This foot support is bounded or bordered by the two feet which protrude upwardly in this position. The slight slant angles the foot of the user toward the vertical pole, tree, column, or the like, and the three point support (against the feet and against the side of the step unit against the tree) makes the step unit stable.

Another step unit can be easily located above the first by the user and on the side of the vertical tree trunk or post opposite the first unit and is quickly useable for the other foot so as to assure a vertical stairway into the branches of the tree or as high as desired up the tree. The unit is easily freed after use and little or no damage is visible to bark or trees or pole, for instance.

Woodsmen and climbers find the step units are easily packed, convenient to use while providing secure footing for climbing and are tough and durable at minimum weight. The final angle of the foot provides good security feeling and an excellent wedge or cinch lock without damage to the ecology.

IN THE DRAWINGS

SPECIFIC DESCRIPTION

Figure 1:
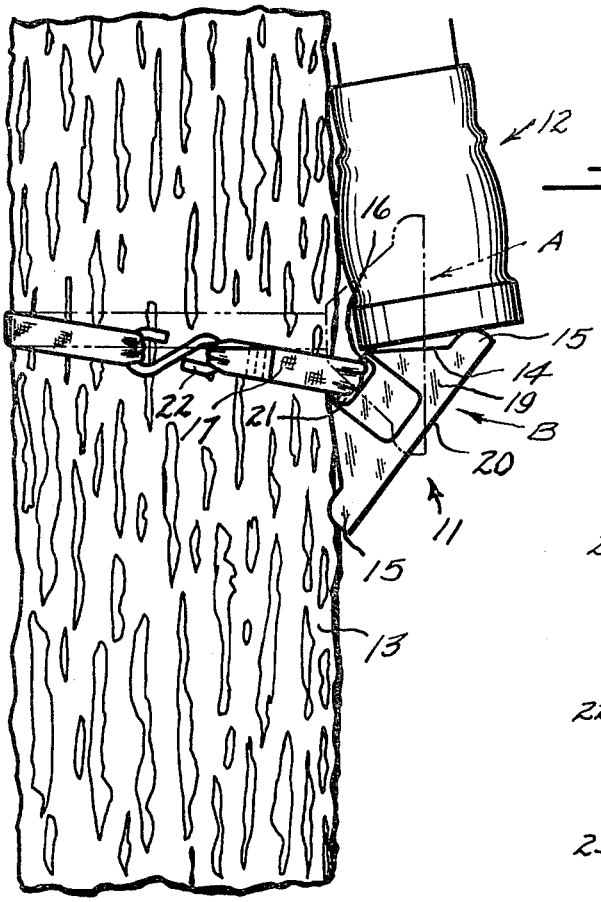
FIG. 1 is a side elevation view of a vertical and generally cylindrical surface shown as a tree trunk and to which a step unit in accord with the present invention has been attached and is lockably wedged by application of the pressure of the user's booted foot. The starting position of the step unit is shown in phantom line.

Referring to the drawings and with first specificity to the FIG. 1, one of the step units 11 of the present invention is seen in use supporting a climbing booted foot 12 of a user, the step unit 11 having first been positioned against the cylindrical perimeter of the vertical surface shown as the tree 13 at phantom line position A, and then tilted clockwise (as shown) and slipped to position B by the application of foot pressure on the relatively shown horizontal surface 14 of the step unit 11, as shown. The converging opposite planar face 14 engages the tree 13. Under load, the feet 15 of the units 11 bridge or span the curvature to engage the tree 13. The structure of the step unit 11 is generally pyramidal and truncated at the top and below the imaginary apex to form a platform 16. Beneath the platform 16 a belt 17 is provided. This is shown in the FIG. 1 in its initial position (phantom line) and its wedge cinching or supporting position (full line). Aside from cinching the belt or webbing 17, the step unit 11 is seen to have slipped slightly downwardly on the tree 13 as pressure and pivoting occurs to take up any slack in the belt or webbing 17 and to select by three point engagement a firm wedge engagement with the tree 13 and which is relatively nondamaging to bark 18 and tree 13 alike. The sides 19 are essentially planar and rise from the generally rectangular base 20 and together with the converging planes of the ends 14 provide the integral substantially pyramidal step unit 11. The sides 19 are both convergent, as will be seen, and the included angle at the apex (not shown but above the truncation represented by platform 16) have a preferred included angle of about 105 degrees. In stress, as will be seen, this results in the ultimate position of the ends 14 in a somewhat acute angle between the support plane for the foot 12 and the relatively vertical surface of the tree 13. A useful range of included angle between about 100 degrees and about 120 degrees has been found. Considering the planes 14 as they engage the base 20, the sides 19 have equal angles at the base 20 and are symmetrical about an imaginary plane bifurcating the side 19 and passing through the apex. As will be seen, the step unit 11 is a shell-like structure having an open base 20 at the bottom, the platform 16 at the top and two openings or slots 21 penetrate the sides 19, one in each side 19 and registering with each other directly beneath the platform 16. The slots or openings 21 provide means for the belt or webbing 17 to extend to encircle the vertical tree 13 or other cylindrical vertical element for climbing. The S ring 22 is a quick-connection and disconnection means for the terminal ends of webbing. It is useful in easily attaching the step unit 11 in the initial or phantom position A. Buckles of a variety of types may be used but the S ring 22 with a suitable lock plate (see FIGS. 2 and 4) is the most economical.

Figure 2:
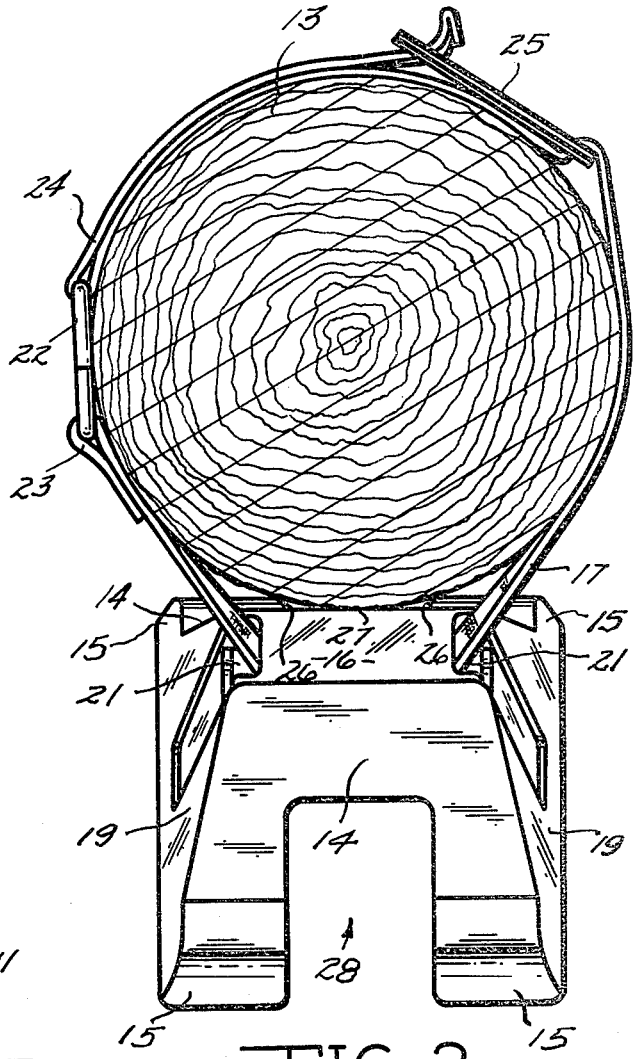
FIG. 2 is a sectional top plan view through the tree of FIG. 1 and taken above the step unit in wedge-locked or cinched position, the sides with the tunnels form a straddling cradle against the tree trunk in three point contact and a boot step surface, respectively. The webbing or belting is shown secured around the tree trunk and through the step unit.

In FIG. 2 the belt 17 is shown extending from both openings 21 and running round the tree 13. The webbing is connected to the S ring 22 at one end by a stitched loop 23. Then a running loop 24 formed by belt 17 beneath the lock plate 25 is slipped over the S ring 22 and the other or terminal end of the webbing 17 is secured adjustably through one orifice in the lock plate 25 which accepts the belt 17. Then the belt 17 passes through an orifice in the other end of the lock plate 25. In this manner a firm positioning of the webbing 17 is initially achieved and as the foot 12 presses down on the surface 14 the step unit 11 pivots and slightly slips to the wedge lock or cinch position shown in FIG. 2 and in FIG. 1 at position B. The feet or toes 15 span to line or point engagement at 26 and the cylindrical surface of the tree 13 also engages the down sliding surface 14 at about point 27 together providing a three point cradling support. This stabilizes the step unit 11 and achieves firm wedge or cinching. In the FIG. 2 the function of the tunnel in allowing the straddle of the feet 15 is best appreciated and the rounded surfaces of the feet or toes 15 allow the unit to slip and avoid bark or surface damage.

Figure 3:
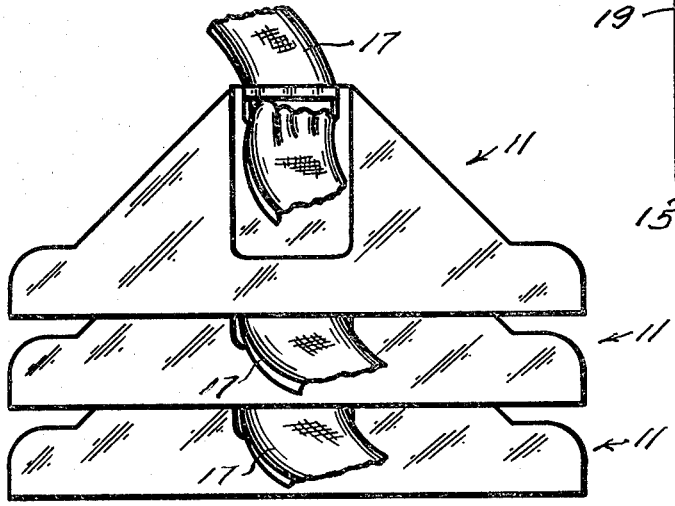
FIG. 3 is a side elevation view of the step units of the present invention and indicating how the step units nest inside the next adjacent element.

The FIG. 3 indicates the nesting of the shell-like step units 11 and indicates the compactness for the user, for example, hunter and woodsman, in carrying plural of the units into the field or placing the units 11 in storage prepared for use and with the belts 17 extending therefrom.

Figure 4:
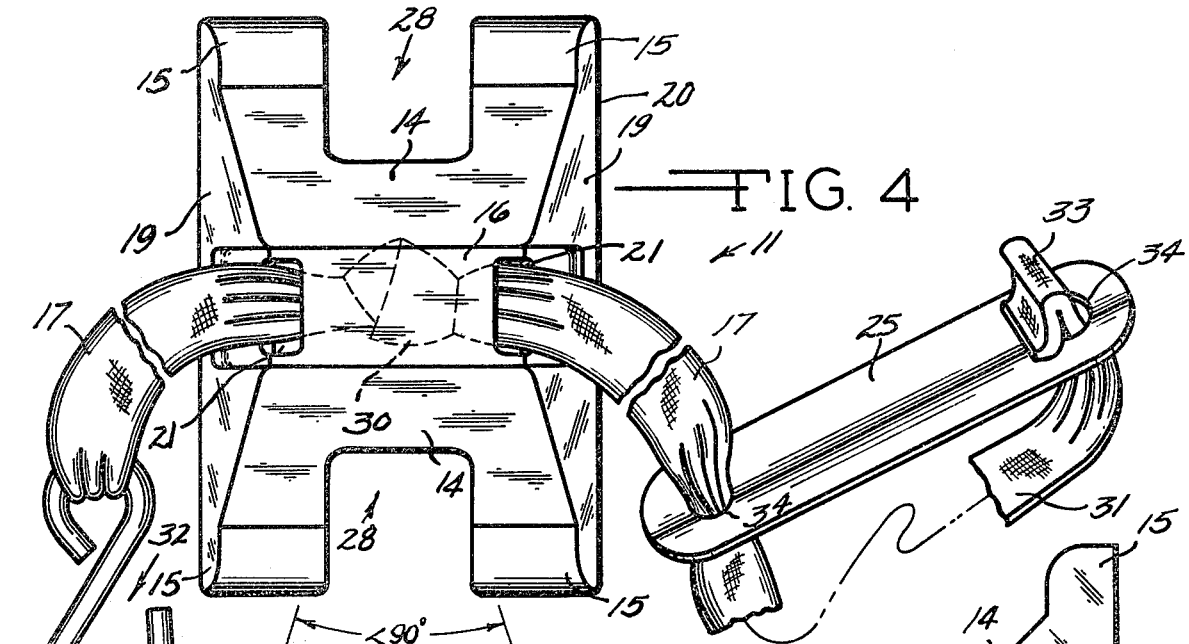
FIG. 4 is a top plan view of the pyramidal shell step units looking down on the platform resulting from the truncation and indicating the symmetry of the external surfaces of the step unit and the rounded surfaces adjacent the tunnels. The quick disconnect plate and the belting are shown in connected perspective.

In the FIG. 4 the step unit 11 can be understood in respect to the symmetry of the unit 11 as a truncated pyramid with a tunnel or channel 28 giving the unit 11 a distinct H appearance and projecting the feet 15 with their rounded toe portions. The planes of the sides 19 and ends 14 converge upwardly to the truncation forming the platform 16 and the openings or slots 21 for the belt 17 are best appreciated as locating the webbing 17 beneath the platform 16. The belt 17 is located by the knot 30 in the cavity of the step unit 11 and beneath the platform 16. In this view the function of the S ring 22 can be better appreciated since the loop portion 31 of the webbing 17 is inserted in the open hook portion 32 of the S ring 22 and the belting is then snugged up by pulling on the free end 33 of the webbing 17 on the lock plate 25. The round openings 34 at each end of the lock plate 25 crowd the belt 17 so that upon firming the tension of the belt 17, the lock plate 25 holds the belt or webbing 17 as set. The general rectangular base 20 is best appreciated in this FIG. 4.

Figure 5:
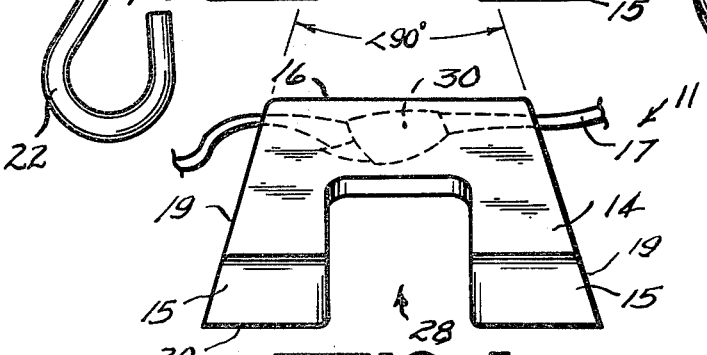
FIG. 5 is a front elevation view of the structure seen in FIG. 4 but with the terminal hardware removed and looking through the tunnel forming the extending feet.
Figure 6:
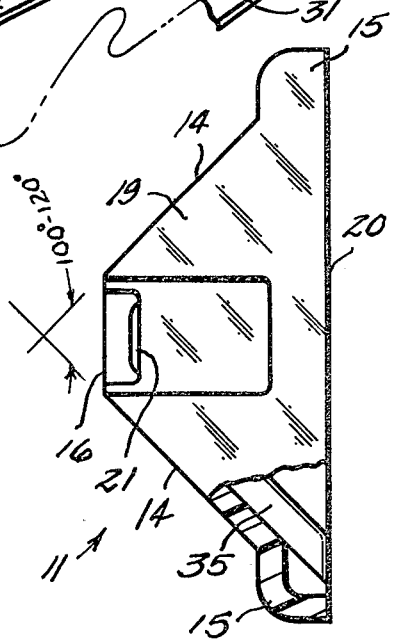
FIG. 6 is a partially sectioned side elevation view of the structure of FIGS. 4 and 5 broken away at one of the feet or toes to indicate a reinforcing rib.
Figure 7:
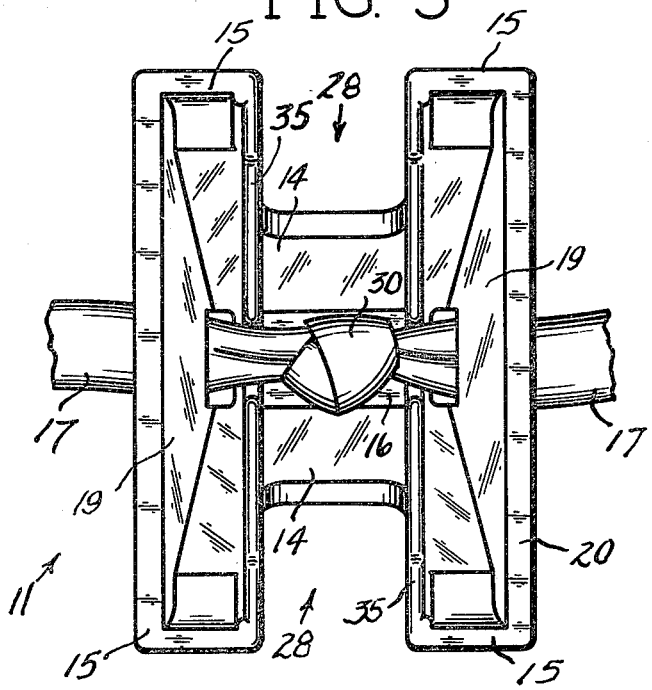
FIG. 7 is a bottom plan view of the structure seen in FIGS. 4, 5 and 6 and best revealing the shell construction of the step unit, its reinforcing ribs and the knotted means for securing the webbing between the openings beneath each end of the platform at the truncation.

FIG. 5 is an elevation view from which the location of the knot 30 in step unit 11 and between openings 21 retains the belt 17 from chance withdrawal. The tunnel or channel 28 which separates the feet 15 is also illuminated. In the FIG. 6, the elevation looking at the side 19 and with the webbing 17 removed, the platform 16 formed by the truncation of the pyramidal structure can be appreciated and the reinforcement by the ribs 35 revealed by removal of a part of the wall 19 at a point above the foot 15 indicates the manner of strengthening the entire step unit 11 without deviating from the objective of using a lightweight and integral molded shell with nestable capabilities. From the FIG. 7 the role of the reinforcing ribs 35 is best appreciated as this strengthens the legs formed by the walls 14, provides transverse rigidity against torsional stressing of the feet 15 by integrally flanking the tunnel 28 and provides integral buttress support for the platform 16. The base 20 is seen as generally rectangular and the tunnel or channel entry 28 separates the feet 15 to provide a straddle capability expressed earlier in the FIGS. 1 and 2.

In operation, the user of the described step units 11 carries several of these units to the use site. Hunters find they compactly pack or locate in hiking or travelling gear. The units 11 are fastened to the tree as snuggly as possible by belt 17 drawing the platform 16 into contact with the vertical surface of a tree, for example. This projects the leg portions, which include the rounded feet 15, outwardly from the tree. By applying down pressing force on the uppermost planar end 14, the step unit 11 pivots from the position A to the position B with some slip depending on the tautness of belt 17. As the pivoting and slipping occurs, the step unit 11 is wedged firmly against the tree 13 with the toes or the feet 15 astraddle the curvature of the trunk of the tree 13 and with a portion of the tree contacting the lower planar surface 14 above and between the feet 15. The webbing 17, as stressed, secures this position and allows the user to easily climb the tree 13 and place another step unit 11 on the opposite side of the tree 13 from the first place unit 11. With several of the step units 11, tree climbing and pole climbing is greatly facilitated and upon completion of use the step units 11 are easily removed from the trees 13 and restored in their nesting relation for packing. No damage results to the trees because no penetration of bark occurs and the light weight of the units assures convenience in the woods or on the trails.

While various materials may be used to cast or form the shell-like step units 11 as, for example, in aluminum, die cast metal, magnesium, and the like, the preferred embodiment is an integral casting of a polycarbonate plastic sold under the trademark LEXAN, (a product of General Electric Co.) and filled with about 12 percent of fiberglass by weight. This results in a strong and tough step unit. Nylon webbing for the belts has proved the most satisfactory. The simplicity of forming the hollow body of the step unit is evident since it is also amenable to drape forming and thermoplastic shaping.

Having thus described our invention and the preferred embodiment thereof, those skilled in the art will perceive modifications, improvements and changes. Such modifications, improvements and changes within the skill of the art are intended to be included within the spirit of the present invention, limited only by the scope of our hereinafter appended claims.

We claim:

1. A tree step unit comprising:

an integrally formed pyramidal nesting shell housing having a truncated platform and pair of openings therethrough substantially at the truncation and including a pair of spaced-apart feet having rounded exteriors on each end of a substantially rectangular base with two sides converging toward said platform and connected integrally to said feet; and a belt through said openings, said belt being adjustable and lockable to hold said housing against a vertical surface and present one of said sides in a substantially horizontal load support position.

2. A tree step unit in accord with claim 1 wherein said belt is a piece of webbing running adjustably and lockably through a lock plate.

3. A tree step unit comprising:

an integrally formed pyramidal nesting shell housing truncated and forming a platform at the truncation having a pair of side openings therethrough and including feet at the corners of the base of said step unit, said feet having rounded exterior edges extending from said base beyond the plane of two opposite sides of said unit which sides converge toward said truncation in an included angle exceeding 100 degrees and less than 130 degrees; and a webbing through said openings and secured beneath said platform and adjustable in extension and selectively lockable to hold said platform against a vertical surface.

4. In the combination of claim 3 wherein a lock plate is secured to one end of said webbing and said other end of said webbing is adjustably and lockably secured to said lock plate.

5. In the combination of claim 3 wherein said included angle is about 105 degrees.

6. In the combination of claim 3 wherein said shell housing nestably receives another pyramidal step unit and others of said units are similarly stackable and nestable in the next adjacent unit.

7. In the combination of claim 3 wherein said shell housings are fiberglass filled plastic molded with internal and nestable plastic integral rib reinforcement.

8. In the combination of claim 7 wherein said plastic is a polycarbonate filled with about 12 percent of fiberglass by weight.

* * * * *